US005309334A

United States Patent [19]

Willison

[11] Patent Number: 5,309,334

[45] Date of Patent: May 3, 1994

[54] FLORAL LIGHT FIXTURE

[76] Inventor: Lawrence H. Willison, Rte. 3 - Box 293, Mt. Pleasant, Iowa 52641

[21] Appl. No.: 64,902

[22] Filed: May 24, 1993

[51] Int. Cl.[5] ..... F21V 33/00

[52] U.S. Cl. ..... 362/122; 362/253; 362/154; 362/147; 362/252; 362/806

[58] Field of Search ..... 362/122, 123, 147, 249, 362/250, 252, 253, 806, 808, 154

[56] References Cited

U.S. PATENT DOCUMENTS

| | | | |
|---|---|---|---|
| 2,535,372 | 12/1950 | Schaeffer et al. | 362/250 |
| 3,030,735 | 4/1962 | Bodkins | 362/154 |
| 3,609,343 | 9/1971 | Howlett | 362/806 |
| 3,711,696 | 1/1973 | Sieloff | 47/41 |
| 4,852,832 | 8/1989 | Delaney | 248/65 |
| 4,855,882 | 8/1989 | Boss | 362/249 |
| 5,057,981 | 10/1991 | Bowen et al. | 362/249 |

FOREIGN PATENT DOCUMENTS

| | | | |
|---|---|---|---|
| 203099 | 4/1959 | Austria | 362/122 |

*Primary Examiner*—Ira S. Lazarus
*Assistant Examiner*—Sara Sachie Raab
*Attorney, Agent, or Firm*—Rhodes & Ascolillo

[57] ABSTRACT

A floral lighting fixture for attachment to a wall and for decoratively lighting and displaying a floral arrangement, the floral lighting fixture including a light rack and a wall mount for mounting on the wall, the light rack including two extended arms, the two extended arms being joined to one another at approximately the midpoints thereof, each of the two extended arms having a plurality of light sources provided thereon, and each of the two extended arms having a bendable joint provided along its length.

19 Claims, 5 Drawing Sheets

FLORAL LIGHT FIXTURE

BACKGROUND

1. Field of the Invention

The present invention relates to the field of floral lighting fixtures, such as are used for illuminating and displaying a floral arrangement.

2. Description of the Related Art

U.S. Pat. No. 5,057,981 relates to a decorative lighted configuration that includes a flexible conduit frame having a light source, for example, one or more strings of lights, disposed therein.

U.S. Pat. No. 3,711,696 discloses a decorative night light having a plurality of simulated flowers mounted around a light bulb.

U.S. Pat. No. 4,852,832 relates to a decorative light holder for displaying ornate lights along straight and curvilinear paths and having adhesive thereon for adhering the light holder to window frames, door frames, etc.

U.S. Pat. No. 4,855,882 discloses an apparatus for providing strip lighting on floors, walls, or the like, the apparatus lying flush with the adjacent surfaces and protruding only slightly therefrom.

U.S. Pat. No. 3,609,343 relates to a light display for use within a fish tank or the like having a plurality of optical fibers arranged with their light-emitting end faces aligned toward the viewing area.

SUMMARY OF THE INVENTION

In one aspect, the invention generally features a floral lighting fixture for decoratively lighting and displaying a floral arrangement, the floral lighting fixture including a light rack and a wall mount, the light rack and the wall mount being attachable to and detachable from one another, the light rack including at least two extended arms, each of the two extended arms having at least one light source provided thereon, the two extended arms being pivotally joined to one another at a pivot point, and each of the two extended arms having at least one bendable joint provided along its length.

Preferably, the bendable joint provided along the length of each of the two extended arms includes a pivotable joint; each of the extended arms is provided with at least two pivotable joints, the pivot point being disposed intermediate between the two pivotable joints provided on each of the two extended arms; the light rack additionally includes at least one electrical terminal provided thereon, the electrical terminal being electrically connected to each of the light sources provided on each of the extended arms, and the wall mount includes at least one powered electrical terminal, the powered electrical terminal being configured to interlock with the electrical terminal provided on the light rack; the wall mount additionally includes a holder apparatus for holding the floral arrangement; the holder apparatus includes an apparatus for holding a floral arrangement element, the floral arrangement element including a foam member; the holder apparatus includes a container, the container including a bottom and upstanding side walls, the upstanding side walls being of lattice design and having open spaces; the wall mount additionally includes a wall mountable receptacle, the powered electrical terminal being disposed within the wall mountable receptacle, and the holder apparatus projecting outward from the wall mountable receptacle; the floral lighting fixture additionally includes a power cord extending from the wall mountable receptacle, and a conventional electrical connector provided on the power cord, the power cord being electrically connected to the powered electrical terminal, whereby the floral lighting fixture can be electrically connected to a conventional electrical outlet. Alternatively, the floral lighting fixture additionally includes an apparatus for electrically connecting the powered electrical terminal to a switched outlet box, whereby the floral lighting fixture can be powered and controlled by the switched outlet box.

In another aspect, the invention generally features a floral lighting fixture for attachment to a wall and for decoratively lighting and displaying a floral arrangement, the floral lighting fixture including a light rack and a wall mount for mounting on the wall, the light rack including two extended arms, the two extended arms being joined to one another at approximately the midpoints thereof, each of the two extended arms having a plurality of light sources provided thereon, and each of the two extended arms having a bendable joint provided along its length.

Preferably, each of the two extended arms is provided with two pivotable joints, each of the midpoints of the two extended arms being disposed intermediate between the two pivotable joints provided on each of the two extended arms; the light rack additionally includes an electrical terminal projecting outward therefrom, the electrical terminal of the light rack being electrically connected to each of the plurality of light sources provided on each of the extended arms, and the wall mount includes a powered electrical terminal, the powered electrical terminal being configured to interlock with the electrical terminal provided on the light rack to thereby both support the light rack and electrically power the light sources provided on the light rack; the wall mount additionally includes a holder apparatus for holding the floral arrangement; the holder apparatus includes a container, the container including a bottom and upstanding side walls, the upstanding side walls being of lattice design and having open spaces; the floral lighting fixture additionally includes a wall mountable receptacle, the wall mountable receptacle including the powered electrical terminal, and the holder apparatus projecting outward from the wall mountable receptacle; the floral lighting fixture additionally includes a power cord extending from the wall mountable receptacle, and a conventional electrical connector provided on the power cord, the power cord being electrically connected to the powered electrical terminal, whereby the floral lighting fixture can be electrically connected to a conventional electrical outlet. Alternatively, the floral lighting fixture additionally includes an apparatus for electrically connecting the powered electrical terminal to a switched outlet box, whereby the floral lighting fixture can be powered and controlled by the switch outlet box;

In yet another aspect, the invention generally features a floral lighting fixture for attachment to a wall and for decoratively lighting and displaying a floral arrangement, the floral lighting fixture including: a light rack; a wall mount; the light rack and the wall mount being attachable to and detachable from one another; the light rack including at least two extended arms; each of the two extended arms having a plurality of light sources provided thereon; the two extended arms being pivotally joined to one another at a pivot point; and each of the two extended arms being provided with two pivotable joints, the pivot point being disposed intermediate between the two pivotable joints provided on each of the two extended arms; an electrical terminal provided on the light rack, the electrical terminal being electrically connected to each of the plurality of light sources provided on each of the extended arms; the wall mount including a powered electrical terminal configured to interlock with the electrical terminal provided on the light rack; a holder apparatus for holding the floral arrangement; the holder apparatus including a container, the container including a bottom and upstanding side walls, the upstanding side walls being of lattice design and having open spaces; and a power cord extending from the wall mountable receptacle, and a conventional electrical connector provided on the power cord, the power cord being electrically connected to the powered electrical terminal, whereby the floral lighting fixture can be electrically connected to a conventional electrical outlet.

One object of the present invention is the provision of a floral lighting arrangement that is highly versatile, in that it can be configured in a variety of aesthetically pleasing positions to complement various floral displays.

Another object of the invention is the provision of such a floral lighting display that is economically manufactured and trouble free in operation.

The invention will now be described by way of a particularly preferred embodiment, reference being made to the accompanying drawings, wherein:

DESCRIPTION OF THE PREFERRED EMBODIMENT

Figures 1, 2:
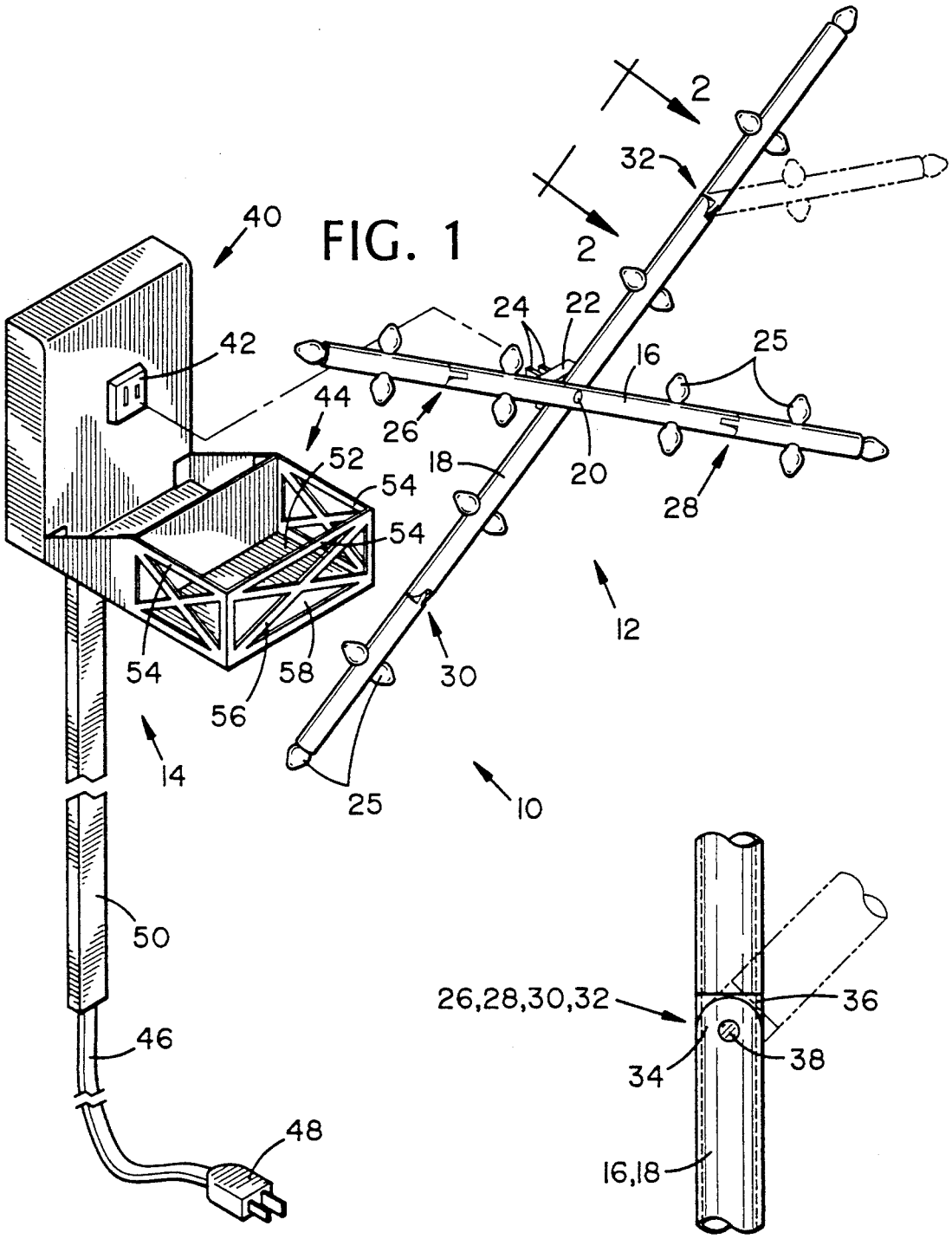
FIG. 1 is a perspective view of a floral lighting display constructed according to the present invention, showing a light rack of the invention separated from a wall mount of the invention.
FIG. 2 is a detailed elevational view of a hinge used in a light rod of the floral lighting display of FIG. 1.

Referring now most particularly to FIGS. 1 and 2, a floral lighting display 10 constructed according to the invention generally includes a light rack component 12 and a wall mounting component 14.

The light rack 12 includes two elongated preferably tubular rods 16 and 18 that are pivotally joined to one another by means of a pivot pin 20, the pivot pin 20 being preferably located at about the midpoints of the two rods 16 and 18. The pivot pin 20 connects to a modular electrical plug unit 22, which is positioned behind the rods 16 and 18, the plug unit 22 being provided with two conventional electrical prongs 24. A number of light sources 25, preferably miniature light bulbs, such as have become common for Christmas decorations, are mounted along each of the rods 16 and 18. The light sources may be either colored or not, as is desired.

Each of the rods 16 and 18 is provided with two hinges, the hinges being located at approximately the two quarter points of each of the rods 16 and 18. Thus, rod 16 is provided with hinges 26 and 28, while rod 18 is provided with hinges 30 and 32. Due to the pivot pin 20 and the hinges 26, 28, 30, and 32, the light rack 12 can be configured in a variety of positions to complement various sizes and shapes of floral displays.

A detailed view of the hinges 26, 28, 30, and 32 is shown in FIG. 2. Each of the hinges 26, 28, 30, and 32 includes a bifurcated portion 34 of the respective rod 16 or 18, a narrowed portion 36 of the respective rod 16 or 18 that is positioned between the two prongs of the bifurcated portion 34, and a throughgoing pin 38 that passes through both prongs of the bifurcated portion 34 and the narrowed portion 36. A relatively snug frictional fit between the narrowed portion 36 and the prongs of the bifurcated portion 34 causes the rods 16 and 18 to retain the configuration in which they are placed.

The wall mounting component 14 generally includes a wall receptacle 40, a powered electrical terminal 42 disposed on the wall receptacle 40, a floral arrangement holder 44 attached to the wall receptacle 40, a power cord 46 extending from the wall receptacle 40, a conventional electrical connector (or "plug") 48 provided at the end of the power cord 46, and a power cord protection and containment channel 50 at least partially surrounding the power cord 46.

Preferably, the floral arrangement holder 44 is cantilevered from the wall receptacle 40 such that it projects outward therefrom, as shown, and is generally a container that has a bottom portion 52 and upstanding side walls 54. Even more preferably, at least the side walls 54 of the floral arrangement holder 44 are of a lattice design and include lattice members 56 and opens spaces 58 interspersed therewith.

The powered electrical terminal 42 is preferably a female electrical connector adapted to receive the prongs 24 of the electrical plug unit 22, whereby the light rack 12 can both be supported and additionally supplied with electrical power.

Figures 3, 4:
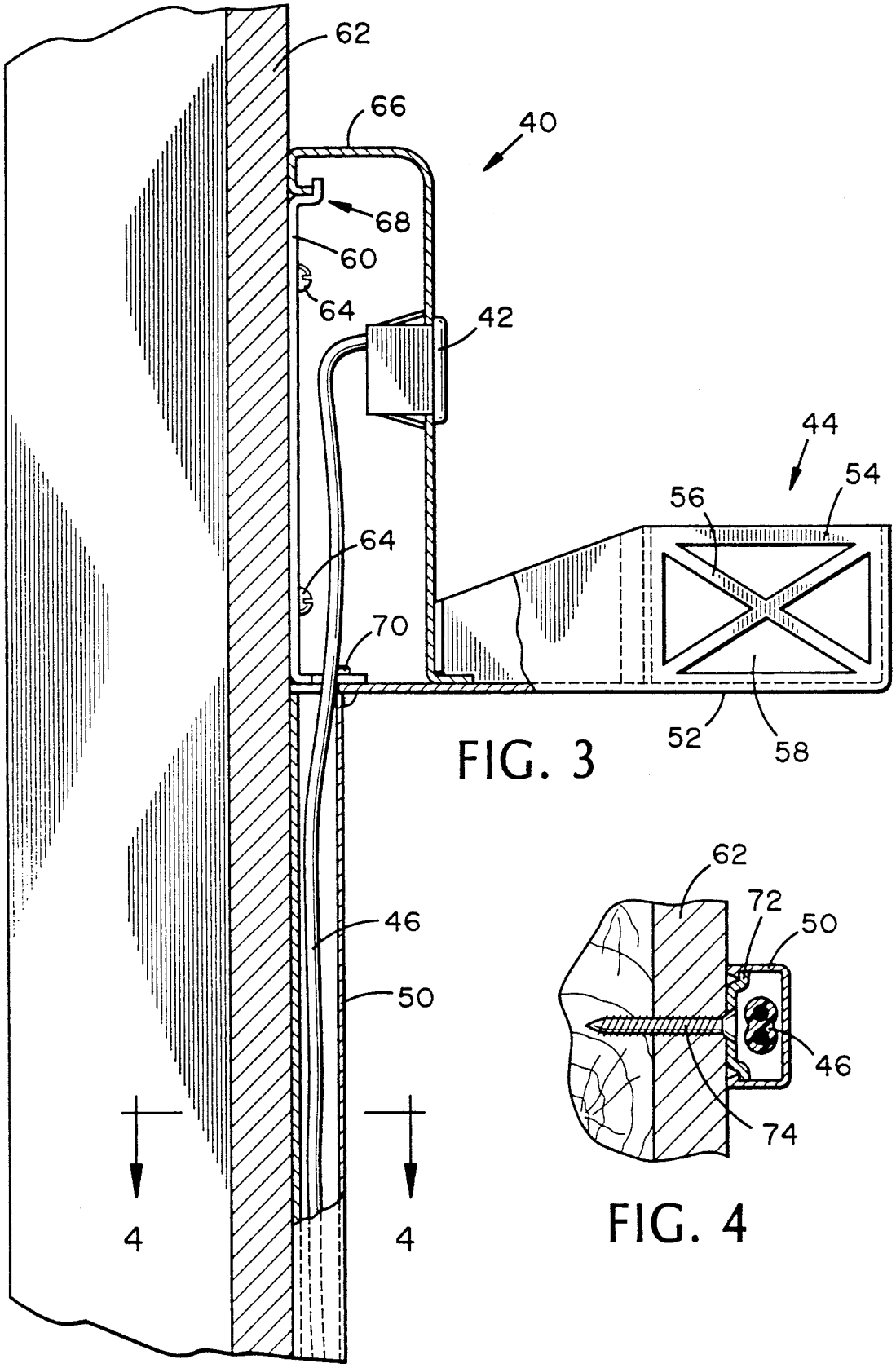
FIG. 3 is a partially sectional side view of the floral lighting display.
FIG. 4 is a detailed sectional view of a power cable conduit of the floral lighting display.

Referring now most particularly to FIGS. 3 and 4, the wall receptacle 40 includes a wall plate 60 that is attachable to a wall 62 (of, for example, a dwelling) via screws 64 and a cover plate 66. The cover plate 66 interlocks with the wall plate 60 by means of a channel configuration 68 and is secured by screws 70, also shown in FIGS. 6 and 7. Similarly, the power cord channel 50 interlocks with another wall plate 72 that is fastened to the wall 62 by screws 74.

Figure 6:
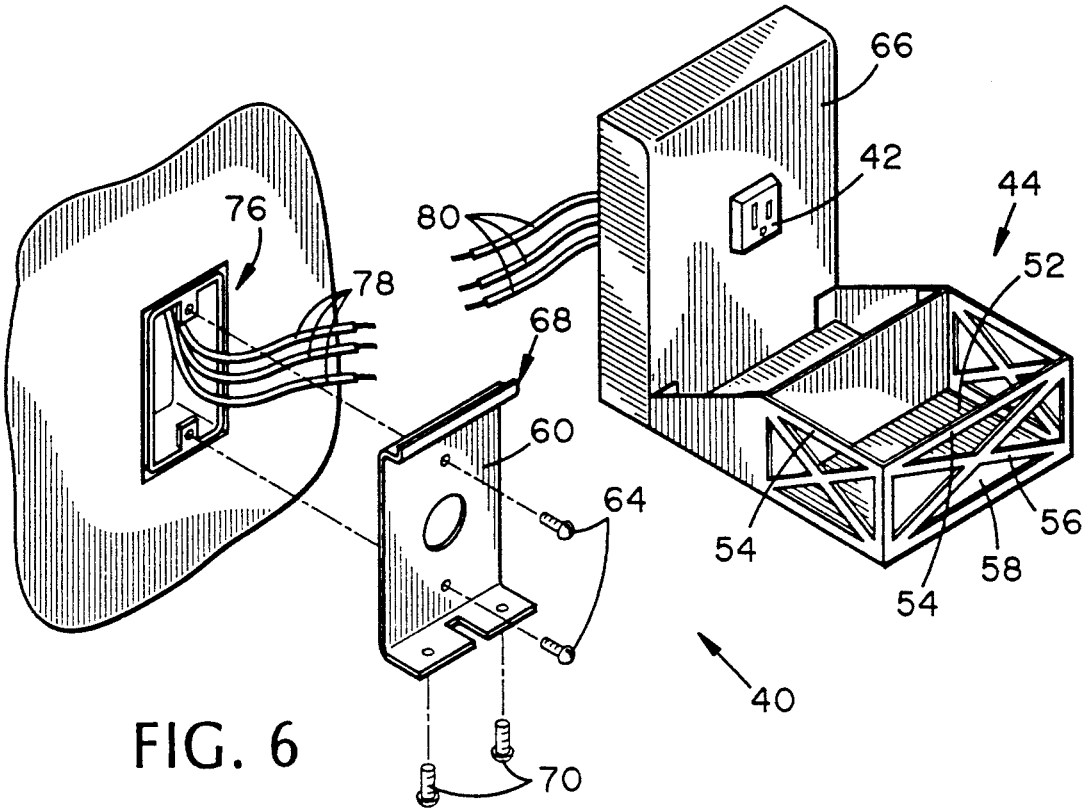
FIG. 6 is an exploded view of the alternative embodiment of FIG. 5.
Figure 5:
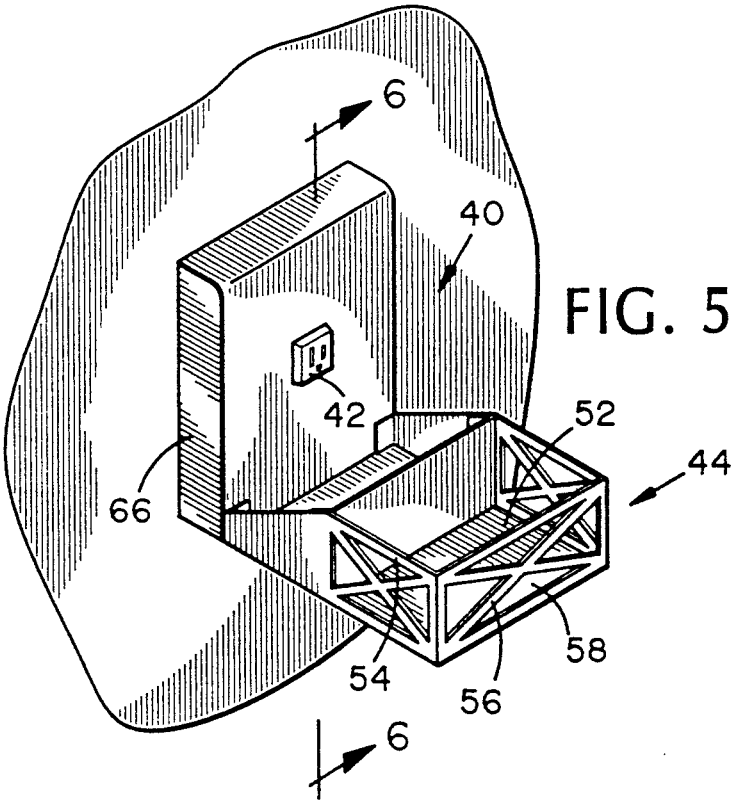
FIG. 5 is a perspective view of a alternative embodiment of the inventive floral lighting display.
Figure 7:
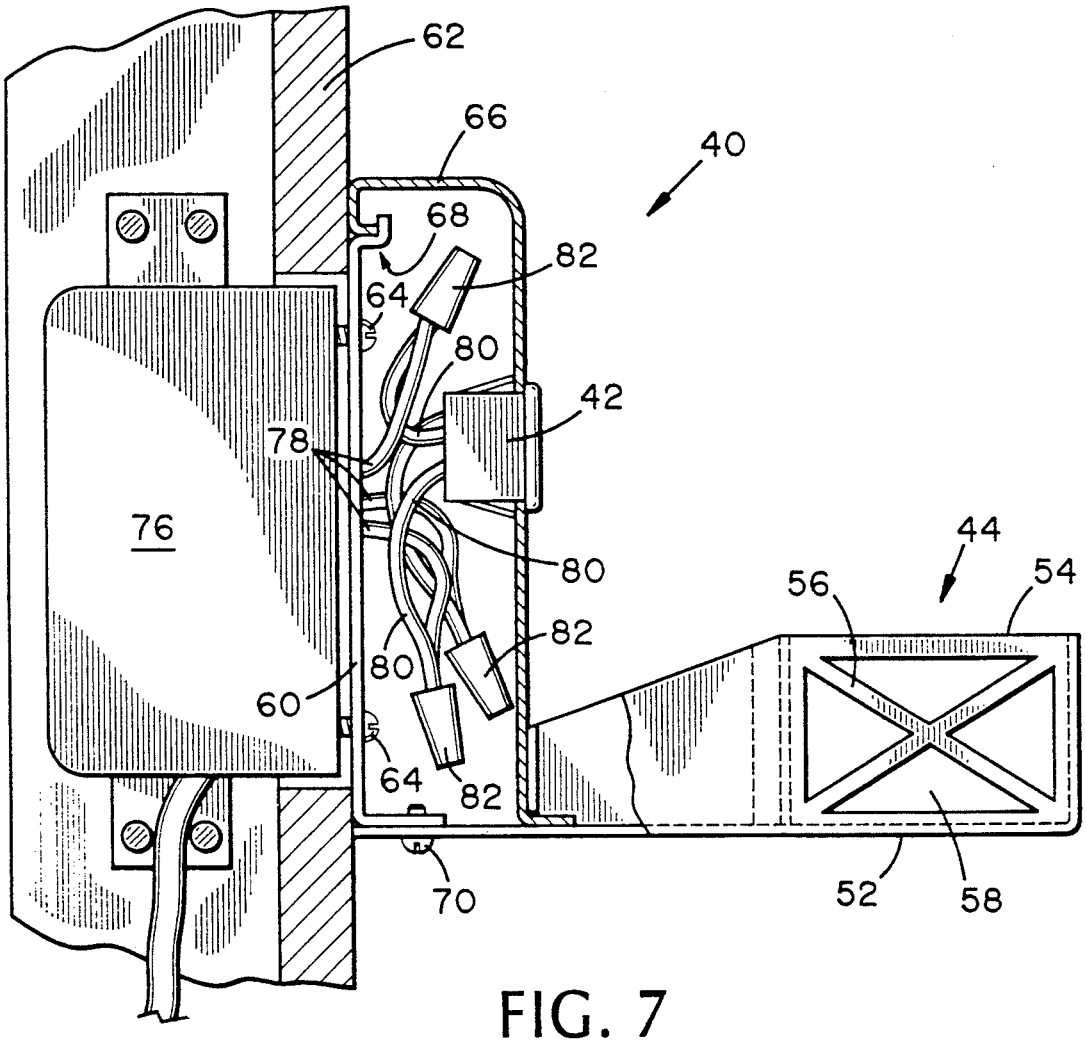
FIG. 7 is a partially sectional view of the alternative embodiment of FIGS. 5 and 6.

An alternative embodiment of the invention, adapted for mounting over a switched outlet box 76, is shown in FIGS. 5–7, wherein like reference numerals have been used to refer to elements that are the same as, or similar to, those already discussed above. In the embodiment shown in FIGS. 5–7, the power cord 46, electrical connector 48, and power cord channel 50 have been eliminated, since, in this embodiment, the floral lighting fixture 10 receives its power through the internal wiring 78 of the outlet box 76. In place of the power cord 46, the floral lighting fixture 10 of FIGS. 5–7 is provided with electrical wiring 80, which is connected with the internal wiring 78 of the outlet box 76, preferably through the use of so-called "wire nut" connectors 82.

Figure 8:
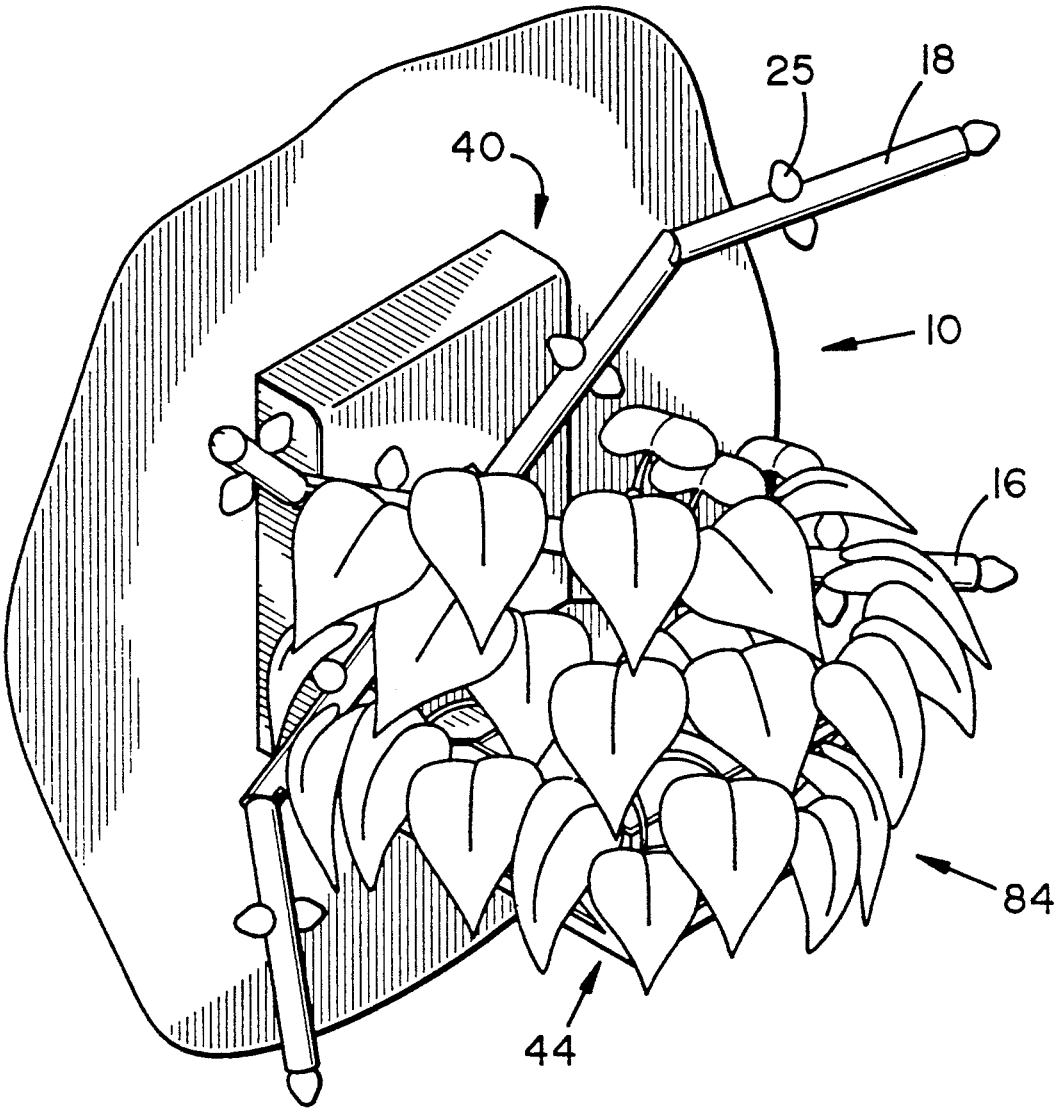
FIG. 8 is a perspective view of the inventive floral display in use.

Finally, FIG. 8 is an illustration of the inventive floral lighting fixture 10 in use and having a floral arrangement 84 disposed within the floral arrangement holder 44. Preferably, the floral arrangement 84 is mounted in a foam block (preferably dry) that is then placed within the floral arrangement holder 44. The floral arrangement itself can be either fresh, dried, or synthetic flowers, or for that matter, any artistic arrangement. Of course, other materials could be substituted for the foam block.

While the invention has been herein described by way of a particular preferred embodiment, various substitutions of equivalents may be effected without departing from the spirit and scope of the invention as set forth in the following claims.

What is claimed is:

1. A floral lighting fixture for decoratively lighting and displaying a floral arrangement, said floral lighting fixture comprising:

a light rack; and a wall mount;

said light rack and said wall mount being attachable to and detachable from one another;

said light rack comprising;

at least two extended arms;

each of said two extended arms having at least one light source provided thereon;

said two extended arms being pivotally joined to one another at a pivot point; and each of said two extended arms having at least one bendable joint provided along its length;

each of said at least one bendable joints being disposed intermediately between the two extreme ends of each of said two extended arms.

2. A floral lighting fixture according to claim 1, wherein said bendable joint provided along the length of each of said two extended arms comprises a pivotable joint.

3. A floral lighting fixture according to claim 2, wherein each of said extended arms is provided with at least two pivotable joints, said pivot point being disposed intermediate between said two pivotable joints provided on each of said two extended arms.

4. A floral lighting fixture according to claim 3, wherein said light rack additionally comprises at least one electrical terminal provided thereon, said electrical terminal being electrically connected to each of said light sources provided on each of said extended arms, and wherein said wall mount comprises at least one powered electrical terminal, said powered electrical terminal being configured to interlock with said electrical terminal provided on said light rack.

5. A floral lighting fixture according to claim 4, wherein said wall mount additionally comprises holder means for holding the floral arrangement.

6. A floral lighting fixture according to claim 5, wherein said holder means comprises means for holding a floral arrangement element, said floral arrangement element comprising a foam member.

7. A floral lighting fixture according to claim 6, wherein said holder means comprises a container, said container including a bottom and upstanding side walls, said upstanding side walls being of lattice design and having open spaces.

8. A floral lighting fixture according to claim 7, wherein said wall mount additionally comprises a wall mountable receptacle, said powered electrical terminal being disposed within said wall mountable receptacle, and said holder means projecting outward from said wall mountable receptacle.

9. A floral lighting fixture according to claim 8, said floral lighting fixture additionally comprising a power cord extending from said wall mountable receptacle, and a conventional electrical connector provided on said power cord, said power cord being electrically connected to said powered electrical terminal whereby said floral lighting fixture can be electrically connected to a conventional electrical outlet.

10. A floral lighting fixture according to claim 8, said floral lighting fixture additionally comprising means for electrically connecting said powered electrical terminal to a switched outlet box, whereby said floral lighting fixture can be powered and controlled by the switched outlet box.

11. A floral lighting fixture for attachment to a wall and for decoratively lighting and displaying a floral arrangement, said floral lighting fixture comprising:

a light rack; and a wall mount for mounting said light rack on the wall;

said light rack comprising:

two extended arms;

said two extended arms being joined to one another at approximately the midpoints thereof;

each of said two extended arms having a plurality of light sources provided thereon; and each of said two extended arms having at least one bendable joint provided along its length.

12. A floral lighting fixture according to claim 11, wherein each of said at least one bendable joint provided on each of said two extended arms comprises two pivotable joints, each of said midpoints of said two extended arms being disposed intermediate between said two pivotable joints provided on each of said two extended arms.

13. A floral lighting fixture according to claim 12, wherein said light rack additionally comprises an electrical terminal projecting outward therefrom, said electrical terminal of said light rack being electrically connected to each of said plurality of light sources provided on each of said extended arms, and wherein said wall mount comprises a powered electrical terminal, said powered electrical terminal being configured to interlock with said electrical terminal provided on said light rack to thereby both support said light rack and electrically power said light sources provided on said light rack.

14. A floral lighting fixture according to claim 13, said wall mount additionally comprising holder means for holding the floral arrangement.

15. A floral lighting fixture according to claim 14, wherein said holder means comprises a container, said container including a bottom and upstanding side walls, said upstanding side walls being of lattice design and having open spaces.

16. A floral lighting fixture according to claim 15, said floral lighting fixture additionally comprising a wall mountable receptacle, said wall mountable receptacle including said powered electrical terminal, and said holder means projecting outward from said wall mountable receptacle.

17. A floral lighting fixture according to claim 16, said floral lighting fixture additionally comprising a power cord extending from said wall mountable receptacle, and a conventional electrical connector provided on said power cord, said power cord being electrically connected to said powered electrical terminal, whereby said floral lighting fixture can be electrically connected to a conventional electrical outlet.

18. A floral lighting fixture according to claim 16, said floral lighting fixture additionally comprising means for electrically connecting said powered electrical terminal to a switched outlet box, whereby said floral lighting fixture can be powered and controlled by the switched outlet box.

19. A floral lighting fixture for attachment to a wall and for decoratively lighting and displaying a floral arrangement, said floral lighting fixture comprising:

a light rack;

a wall mount;

said light rack and said wall mount being attachable to and detachable from one another;

said light rack comprising at least two extended arms;

each of said two extended arms having a plurality of light sources provided thereon;

said two extended arms being pivotally joined to one another at a pivot point; and each of said two extended arms being provided with two pivotable joints, said pivot point being disposed intermediate between said two pivotable joints provided on each of said two extended arms;

an electrical terminal provided on said light rack, said electrical terminal being electrically connected to each of said plurality of light sources provided on each of said extended arms;

said wall mount comprising a powered electrical terminal configured to interlock with said electrical terminal provided on said light rack;

holder means for holding the floral arrangement;

said holder means comprising a container, said container including a bottom and upstanding side walls, said upstanding side walls being of lattice design and having open spaces; and a power cord extending from said wall mountable receptacle, and a conventional electrical connector provided on said power cord, said power cord being electrically connected to said powered electrical terminal, whereby said floral lighting fixture can be electrically connected to a conventional electrical outlet.

* * * * *